US007086910B2

(12) United States Patent
Tanaka et al.

(10) Patent No.: US 7,086,910 B2
(45) Date of Patent: Aug. 8, 2006

(54) CONNECTOR

(75) Inventors: Tsutomu Tanaka, Yokkaichi (JP); Tsuyoshi Mase, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/126,933

(22) Filed: May 11, 2005

(65) Prior Publication Data

US 2005/0255756 A1 Nov. 17, 2005

(30) Foreign Application Priority Data

May 12, 2004 (JP) ..... 2004-142658

(51) Int. Cl.
*H01R 13/514* (2006.01)

(52) U.S. Cl. ..... 439/752

(58) Field of Classification Search ..... 439/752, 439/595, 744, 871, 603
See application file for complete search history.

(56) References Cited

U.S. PATENT DOCUMENTS 5,653,613 A * 8/1997 Shimoda ..... 439/752
5,674,096 A * 10/1997 Duclos et al. ..... 439/752
6,083,058 A * 7/2000 Fujiwara ..... 439/752
6,716,069 B1 * 4/2004 Nakamura et al. ..... 439/752
6,769,940 B1 * 8/2004 Nakano ..... 439/752
6,780,070 B1 * 8/2004 Ishikawa et al. ..... 439/752
6,835,106 B1 * 12/2004 Aihara et al. ..... 439/752
6,935,904 B1 * 8/2005 Ishiyama ..... 439/752

* cited by examiner

*Primary Examiner*—Tho D. Ta
*Assistant Examiner*—Felix O. Figueroa
(74) *Attorney, Agent, or Firm*—Gerald E. Hespos; Anthony J. Casella

(57) ABSTRACT

A connector has a housing (10) with a retainer-mounting hole (16) open at an bottom surface and two opposite side surfaces (19). A retainer (50) is mountable in the retainer-mounting hole (16) and has two side plates (53) that sandwich the side surfaces (53) of the housing (10) therebetween. A to-be-locked portion (51) is provided on each side plate (53). The side surfaces (19) of the housing (10) have front and rear temporary locks (17A, 17B) forward and rearward of the retainer-mounting hole (16) to engage the to-be-locked portions (51) and to hold the retainer (50) at a temporary locking position. Each side surface (19) also has a main lock (18) above the retainer-mounting hole (16) to engage the to-be-locked portions (51) and to hold the retainer (50) at a main locking position.

16 Claims, 14 Drawing Sheets

CONNECTOR

BACKGROUND OF THE INVENTION

1. Field of the Invention

The invention relates to a connector having a retainer.

2. Description of the Related Art

U.S. Pat. No. 6,780,070 discloses a connector with a housing that has cavities for receiving terminal fittings. A retainer-mounting hole extends into the housing and communicates with the cavities. The retainer mount hole is open in the bottom surface of the housing and both side surfaces thereof. The connector also has a retainer that is movable between a temporary locking position and a main locking position on the housing. At the temporary locking position, the retainer permits insertion of the terminal fittings into the cavities and removal of the terminal fittings from the cavities. At the main locking position, the retainer locks the terminal fittings in the cavities. Temporary locking projections are formed on the housing for holding the retainer at the temporary locking position and main locking projections are formed on the housing for holding the retainer at the main locking position.

The temporary locking projections and the main locking projections are arranged vertically on the side surfaces of the housing over the upper end of the retainer-mounting hole. Therefore, the housing has a large vertical dimension. A demand exists for a connector with a small vertical height. The temporary locking projections and the main locking projections could be arranged side-by-side on the side surfaces of the housing along one longitudinal edge of the retainer-mounting hole. However, the mounting posture of such a retainer would be unstable because the locking projections would be localized at one side in the longitudinal direction of the housing. Thus, locking at the temporary locking position is not dependable.

The invention has been completed in view of the above-described situation. Therefore it is an object of the present invention to provide a connector having a small vertical dimension and capable of locking a retainer securely.

SUMMARY OF THE INVENTION

The invention relates to a connector with a housing that has a cavity for accommodating a terminal fitting. A retainer-mounting hole opens to three outer surfaces of the housing and communicates with the cavity. The connector also has a retainer with a proximal portion and two sidewalls projecting from opposite ends of the proximal portion. The retainer is inserted into the retainer-mounting hole in the surface of the housing, so that the sidewalls elastically sandwich the surfaces of the housing therebetween. The retainer is movable between a temporary locking position at which the retainer permits insertion of the terminal fitting into the cavity and removal of the terminal fitting therefrom and a main locking position at which the retainer locks the terminal fitting. A to-be-locked portion is provided on each of the sidewalls of the retainer.

Temporary locks are provided on the side surfaces of the housing that have the retainer-mounting hole. The temporary locks are disposed at a side of the retainer-mounting hole with respect to an insertion direction of the retainer for engaging the to-be-locked portion and retaining the retainer at the temporary locking position. Therefore this construction complies with the demand for a connector having a small vertical dimension.

Main locks are provided on the side surfaces of the housing on which the retainer-mounting hole is formed and at a front side in the insertion direction of the retainer. Therefore the lock at the main locking position is at or near the center of the retainer. The main locks engage the to-be-locked portion and retain the retainer at the main locking position. As a result, the mounting posture of the retainer is stable at the main locking position, and the retainer can be locked reliably at the main locking position The main locks preferably extend along peripheral edges of the retainer-mounting hole and confront a front side of the retainer in the insertion direction.

The temporary locks preferably are formed on the both surfaces of the housing at positions to sandwich the retainer-mounting hole therebetween.

The main lock preferably extends along a portion of a peripheral edge of the retainer-mounting hole that confronts a front side in the insertion direction of the retainer. Main locks also may be on both surfaces of the housing on which the retainer-mounting hole is formed. Thus, the to-be-locked portion is locked to the main lock in a large area, and the retainer can be locked with a high reliability.

The to-be-locked portion slidably contacts the movement guide surface of the main lock while moving the retainer from the main locking position to the temporary locking position. Therefore a large operational force is not required to unlock the retainer from the main locking position. The to-be-locked portion contacts a removal prevention surface of the temporary lock when the retainer has reached the temporary locking position. Thus, the retainer is held securely at the temporary locking position and is not inadvertently removed completely from the housing.

Temporary locks preferably are on both surfaces of the housing to sandwich the retainer-mounting hole. Therefore, the mounting posture of the retainer is stabilized at the temporary locking position and the insertion posture of the retainer is stabilized while mounting the retainer at the temporary locking position.

The to-be-locked portion and the movement guide surface make a line contact in a direction substantially orthogonal to the movement direction of the retainer when the retainer is at the main locking position. Therefore an unlocking operation can be performed easily when the retainer is at the main locking position. On the other hand, the to-be-locked portion and the removal prevention surface make a surface contact at the temporary locking position. Therefore, the retainer cannot be removed easily from the temporary locking position.

The to-be-locked portions are on opposed elastically deformable side plates. Therefore, the retainer is movable between the main locking position and the temporary locking position with the side plates elastically deforming away from one another. The construction ensures a smooth unlocking operation from the main locking position and a smooth operation of returning both side surfaces to the original state at the temporary locking position.

DETAILED DESCRIPTION OF THE PREFERRED EMBODIMENTS

A female connector according to the invention is described below with reference to FIGS. 1 through 15. The connector has a female housing 10 that accommodates a plurality of female terminal fittings 30 and a retainer 50 for locking the female terminal fittings 30 in the housing 10. The female housing 10 has a front end for mating with a male housing (not shown).

Figure 5:
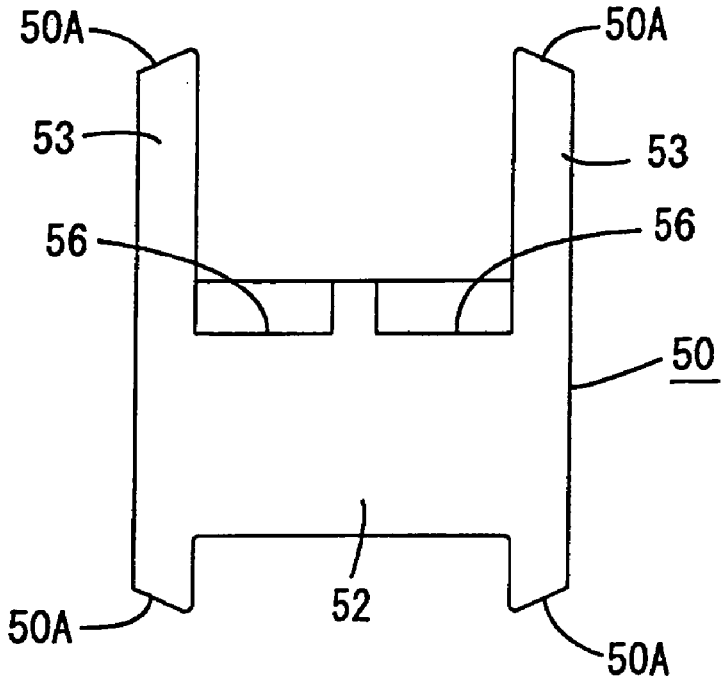
FIG. 5 is a bottom view showing the retainer.

The female terminal fitting 30 is formed by punching a conductive metal plate into a predetermined configuration and then bending the punched conductive metal plate. As shown in FIG. 5, a square pillar 31 is formed at the front end of the female terminal fitting 30 and is configured for connection with a male terminal fitting (not shown). A wire barrel 32 is provided at the rear end of the square pillar 31 and is configured to be caulked to a core at the end of an electric wire W. An insulation barrel 33 is rearward of the wire barrel 32 and is configured to be caulked to a covering of the electric wire W. An elastic contact piece (not shown) is formed inside the square pillar portion 31. When the male terminal fitting (not shown) is inserted into the square pillar 31 from an opening at a front surface thereof. The elastic contact piece contacts the male terminal fitting 30 and deforms to achieve electrical connection between the female terminal fitting 30 and the male terminal fitting. A locking projection 34 is formed vertically on a lower surface of the square pillar 31.

Figure 1:
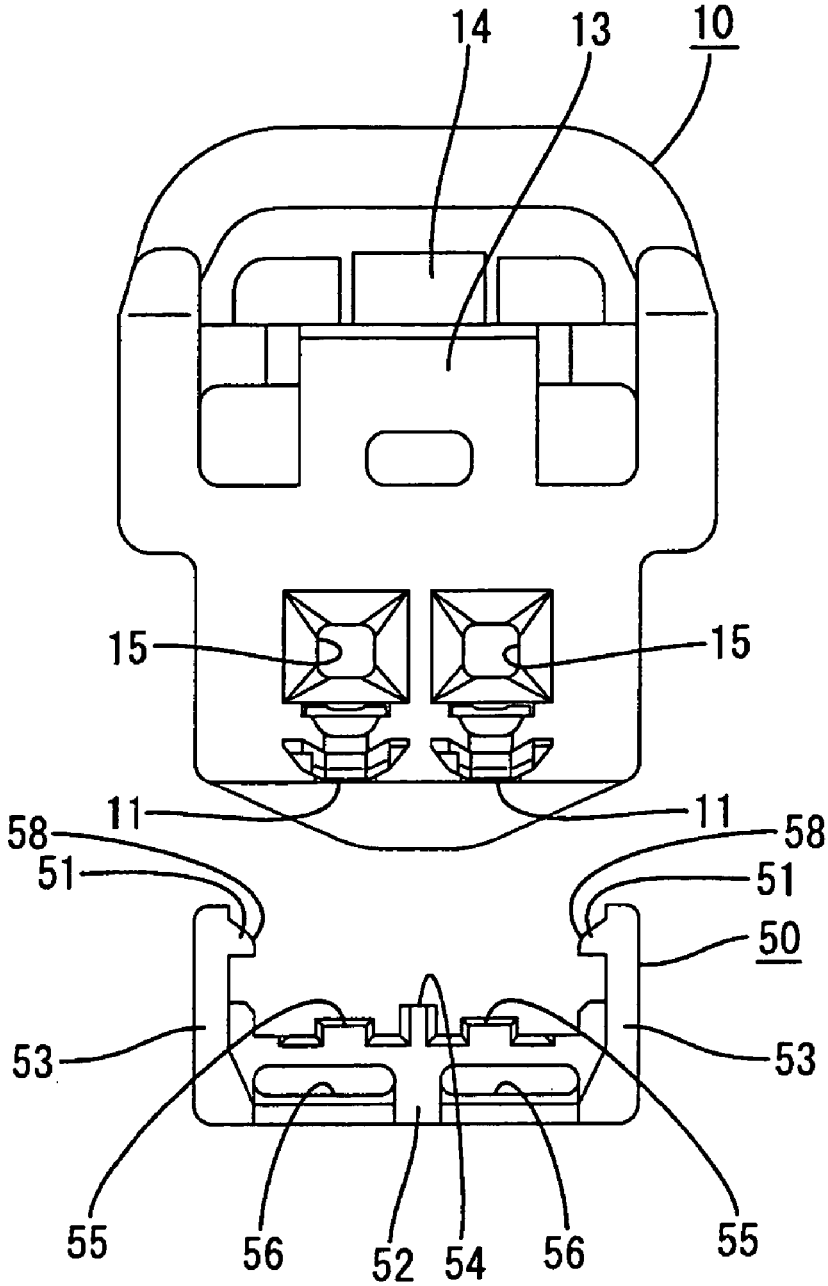
FIG. 1 is an exploded front view showing a connector of an embodiment of the present invention before a retainer is mounted thereon.
Figure 2:
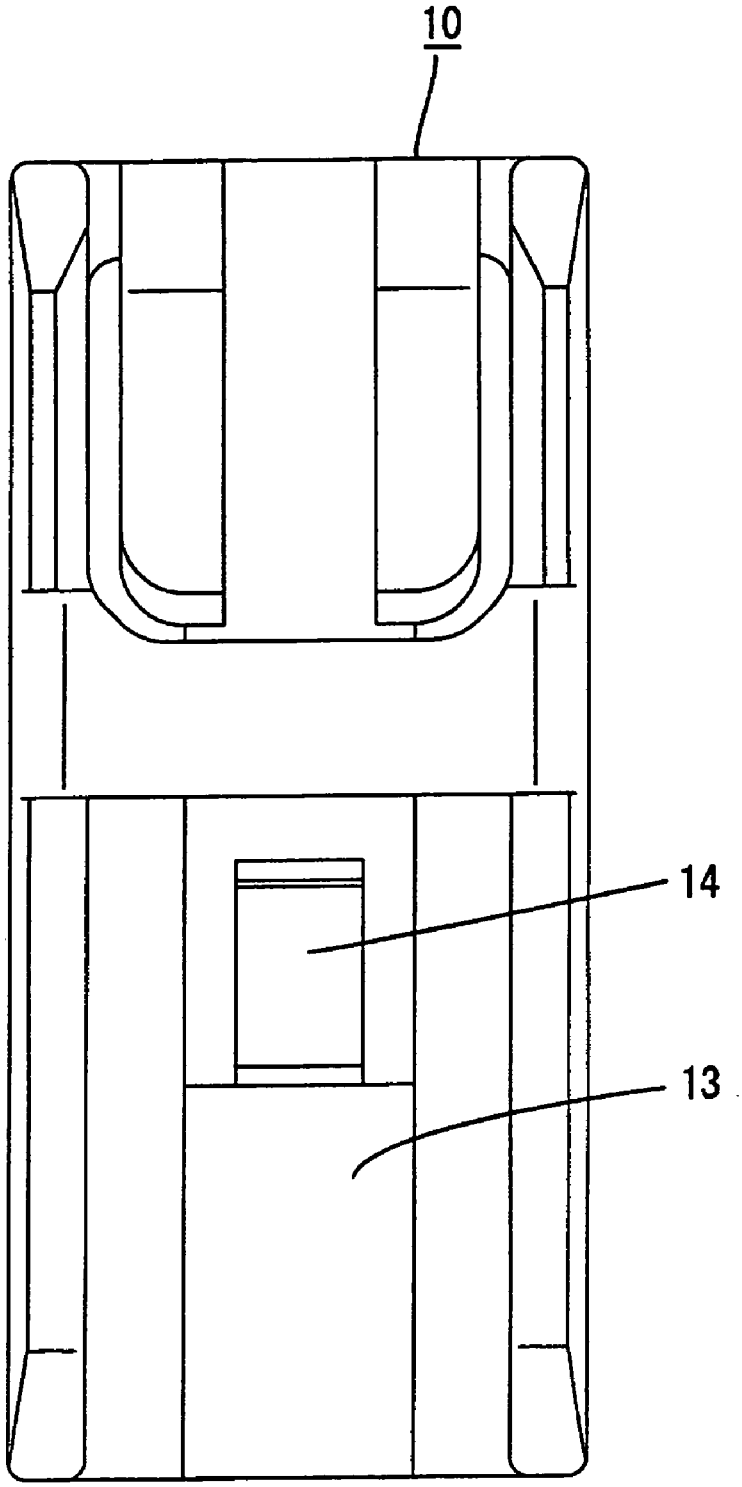
FIG. 2 is a plan view showing the connector.

As shown in FIGS. 1 and 2, the female housing 10 is substantially block-shaped and is made of synthetic resin. A locking arm 13 is formed on an upper portion of the female housing 10 for locking the female housing 10 and the male housing to each other when both housings are fit together normally. The locking arm 13 extends almost the entire length of the female housing 10. A lock 14 projects up from an approximately central position of the upper surface of the locking arm 13 for locking the female housing 10 together with the male housing.

Two cavities 15 are provided side-by-side in the width direction of the female housing 10 and are configured for receiving the female terminal fittings 30 along the longitudinal direction of the female housing 10. A lance 11 is formed on a bottom wall of each cavity 15 for preventing the female terminal fitting 30 from being removed rearward. The lance 11 is elastically deformable and is exposed on the lower surface of the female housing 10. A to-be-locked portion 12 is formed on an upper surface of the lance 11 and projects into the cavity 15. The lance 11 deforms elastically down when the female terminal fitting 30 is inserted into the cavity 15. The lance 11 returns to its original state when the female terminal fitting 30 is inserted into the cavity 15 to a predetermined normal depth. Thus the to-be-locked portion 12 is locked to the rear surface of the locking projection 34 of the female terminal fitting 30.

A bottom surface of the female housing 10 and both side surfaces thereof are opened to form a retainer-mounting hole 16 on which the retainer 50 is mounted. The retainer-mounting hole 16 communicates with an approximately central portion of the cavity 15 in its longitudinal direction and is closed when the retainer 50 is mounted from below on the female housing 10. A retainer-mounting surface 19 is formed on the periphery of the retainer-mounting hole 16 along both side surfaces of the female housing 10 and can be covered with the retainer 50. The retainer-mounting surface 19 is stepped lower than regions forward and rearward from the retainer-mounting surface 19. A dovetail groove (not shown) is formed on the steps forward and rearward from the retainer-mounting surface 19. A tapered cut edge 50A is formed at forward and rearward ends of the retainer 50 to engage the dovetail groove. Thus, the retainer 50 cannot deform excessively (see FIG. 3).

A front temporary lock 17A projects from the retainer-mounting surface 19 immediately forward from the peripheral edge of the retainer-mounting hole 16. A rear temporary lock 17B projects from the retainer-mounting surface 19 immediately rearward from the peripheral edge of the retainer-mounting hole 16, thereby making a pair with the front temporary lock 17A. A main lock 18 projects from a portion of the retainer-mounting surface 19 slightly above the peripheral edge of the retainer-mounting hole 16. A to-be-locked portion 51 of the retainer 50 is locked to the front and rear temporary locks 17A and 17B. Thus, the retainer 50 is retained at a temporary locking position that permits the female terminal fitting 30 to be inserted in and removed from the cavity 15. The retainer 50 can be inserted farther so that the to-be-locked portion 51 is locked to the main lock 18. Thus, the retainer 50 is retained at the main locking position and locks the female terminal fitting 30.

Figure 7:
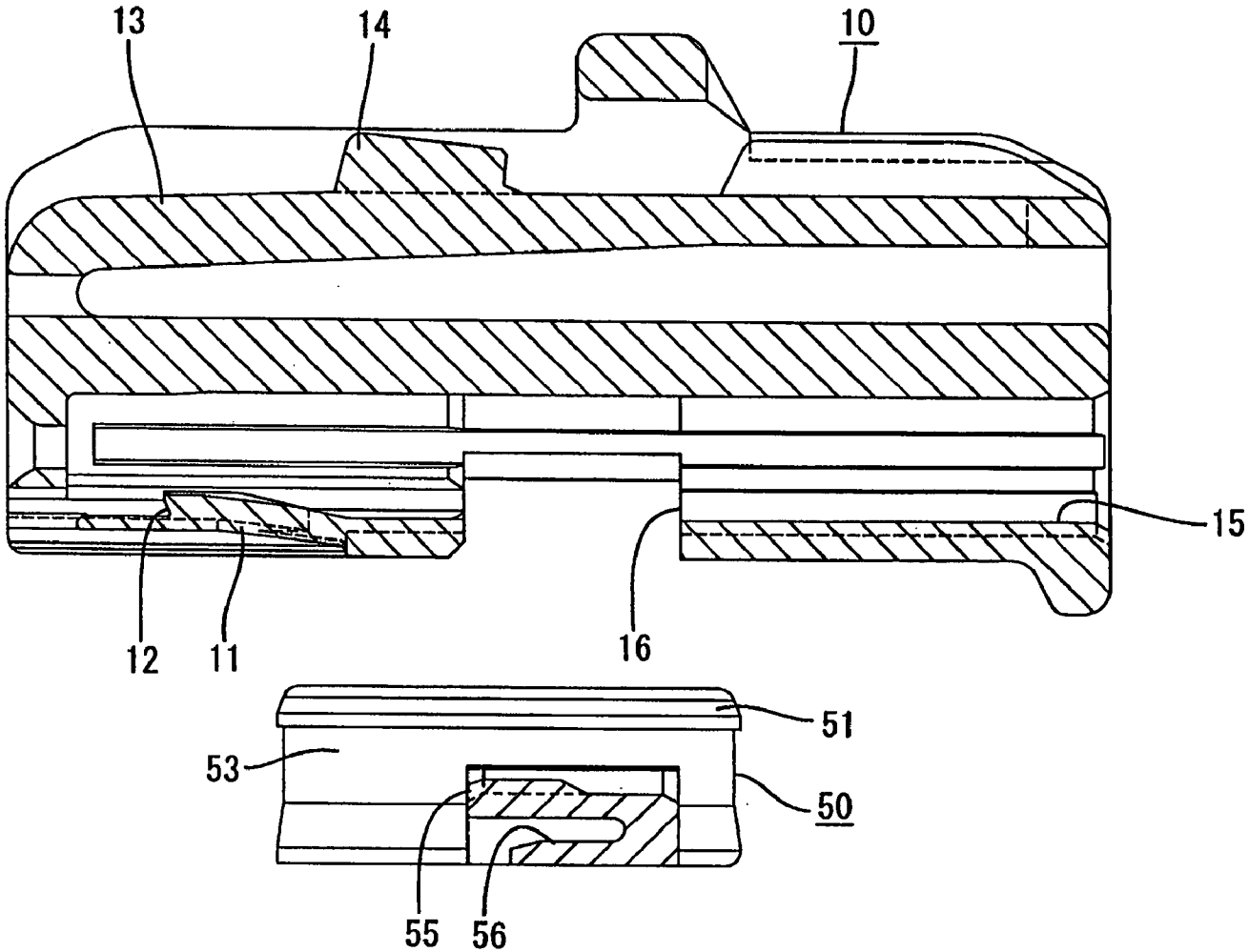
FIG. 7 is an exploded sectional side view showing the connector before the retainer is mounted on the connector housing.
Figure 8:
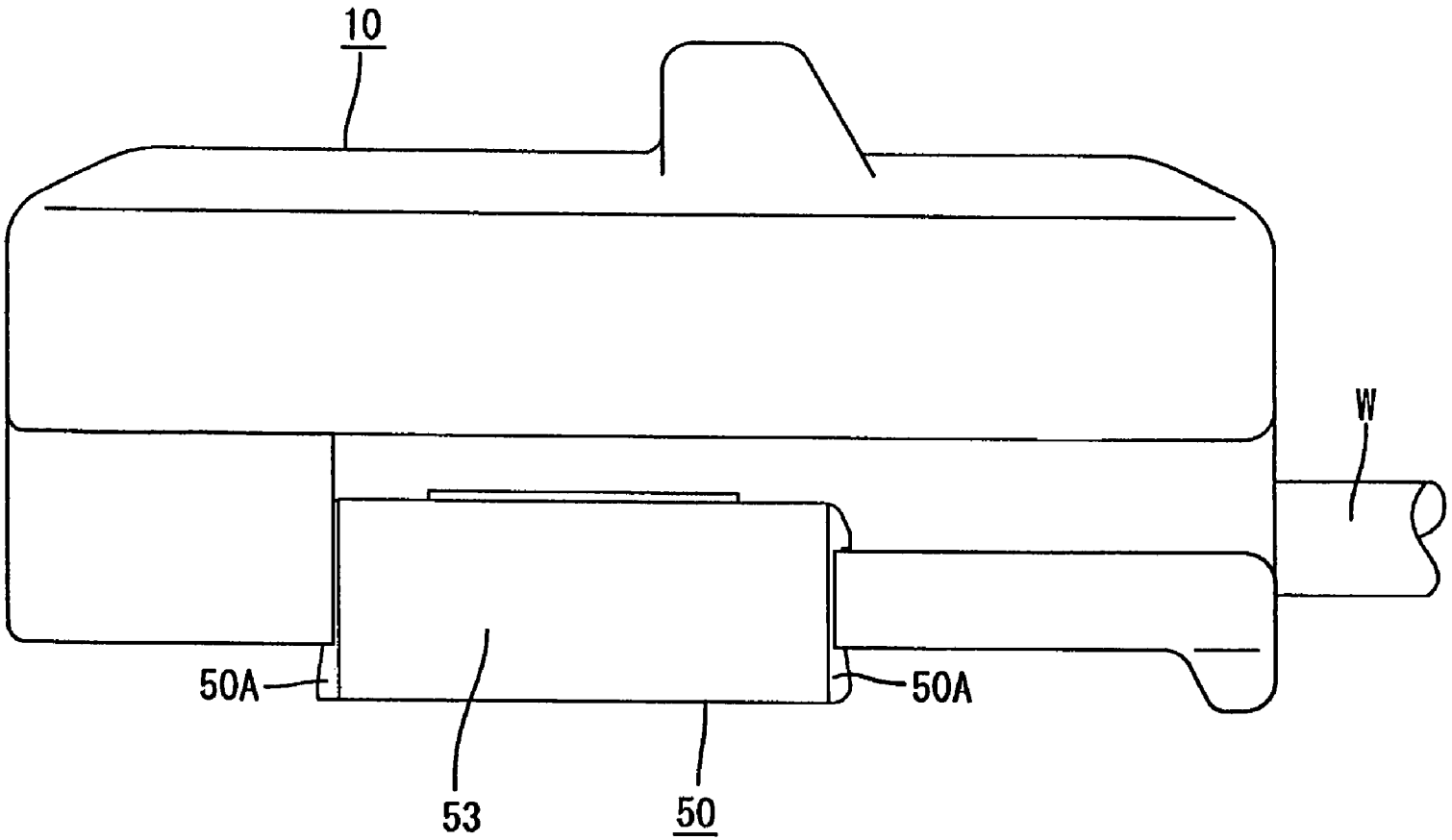
FIG. 8 is a side view showing the connector when the retainer is disposed at a temporary locking position.
Figure 9:
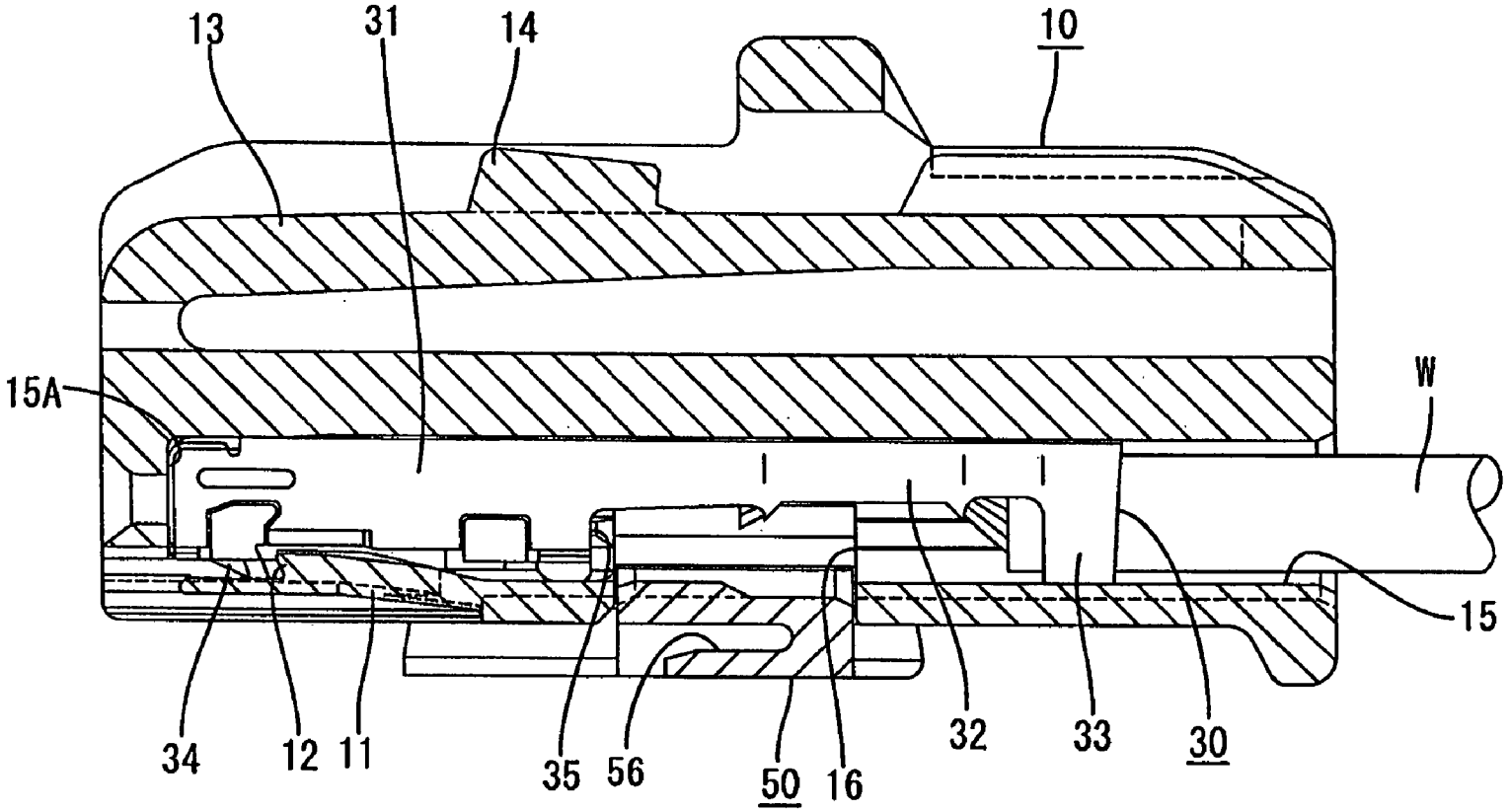
FIG. 9 is a longitudinal sectional view showing the connector when the retainer is at the temporary locking position.
Figure 10:
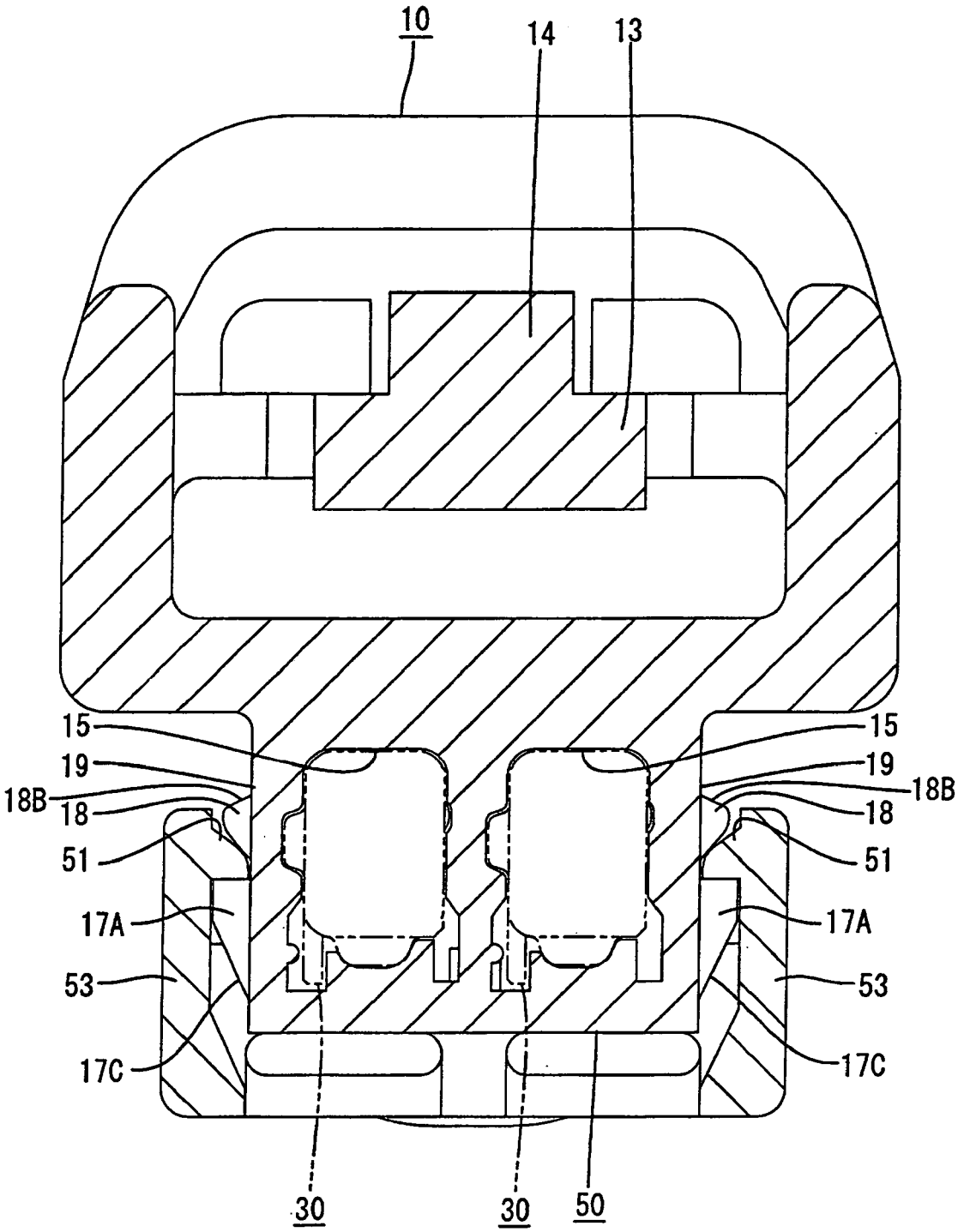
FIG. 10 is a transverse sectional view showing the connector when the retainer is disposed at the temporary locking position.

As shown in FIG. 2, the front temporary lock 17A is larger than the rear temporary lock 17B in the longitudinal and vertical dimensions. More specifically, the front temporary lock 17A is vertically long along a front peripheral edge of the retainer-mounting hole 16. A lower end of the rear temporary lock 17B is substantially on a level with an approximately central position of the front temporary lock 17A in the vertical direction thereof. An upper end of the rear temporary lock 17B is substantially on a level with an upper end of the front temporary lock 17A. The longitudinal dimension of the front temporary lock 17A is almost twice as large as that of the rear temporary lock 17B. As shown in FIGS. 7 and 8, guide surfaces 17C slope up and out from the lower edges of the front and rear temporary locks 17A and 17B to guide the retainer 50 smoothly to the temporary locking position. The upper surface of the front temporary lock 17A also is sloped relative to the moving direction of the retainer 50. However, a removal prevention surface 17E is defined at the top end of the rear temporary lock 17B and an outer surface 17F extends between the guide surface 17C and the removal prevention surface 17E of each rear temporary lock 17B. The removal prevention surface 17E and the outer surface 17F both are substantially planar from the front end to the rear end of the rear temporary lock 17B. The outer surface 17F intersects the guide surface 17C at an obtuse angle, but intersects the removal prevention surface 17E at a substantially right angle. Additionally, the outer surface 17F of each rear temporary lock 17B is substantially parallel to the moving direction of the retainer 50, and hence the removal prevention surface 17E is aligned substantially normal to the moving direction of the retainer 50. Accordingly, the removal prevention surface 17E prevents removal of the retainer 50.

A front end of the main lock 18 substantially aligns with the front end of the front temporary lock 17A. The main lock 18 extends rearward from its front end substantially along an upper peripheral edge of the retainer-mounting hole 16. The rear end of the main lock 18 is slightly forward of the rear edge of the retainer-mounting hole 16. A main lock guide surface 18A slopes up and out from the lower edge of the main lock 18 to guide the retainer 50 smoothly to the main locking position. A movement guide surface 18B slopes down and out from the upper edge of the main lock 18 to guide the retainer 50 smoothly to the temporary locking position.

Figure 4:
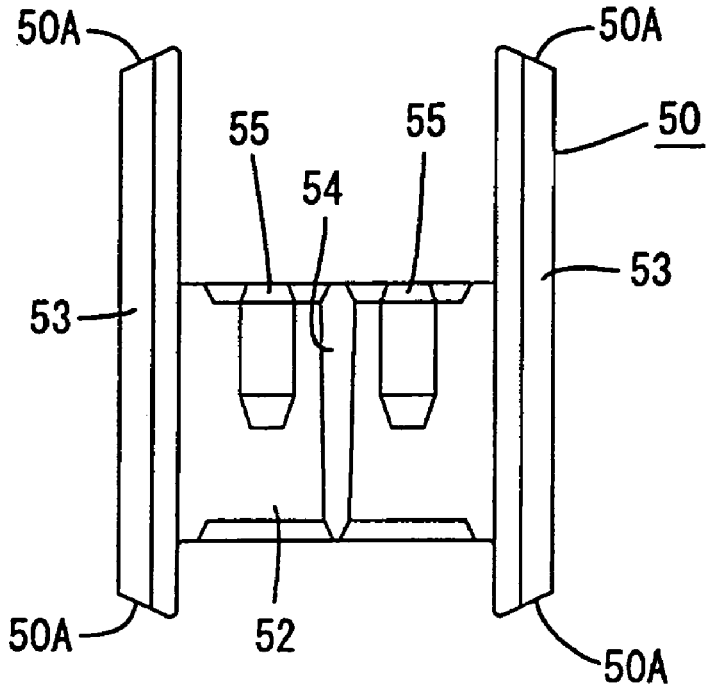
FIG. 4 is a plan view showing the retainer.

The plate-shaped retainer 50 is made of synthetic resin. As shown in FIGS. 1, 4 and 5, the retainer 50 has a base wall 52 and two side plates 53 project almost perpendicularly from the ends of the base wall 52. Thus, the retainer 50 is approximately gate-shaped in a front view. The base wall 52 corresponds dimensionally to the portion of the retainer-mounting hole 16 in the bottom surface of the female housing 10. Thus, the base wall 52 closes the retainer-mounting hole 16 and defines a portion of the bottom wall of the cavity 15. A longitudinally aligned partition 54 projects from an approximately widthwise central portion of the upper surface of the base wall 52 of the female housing 10 and partitions the two cavities 15 from each other. Removal prevention projections 55 project from the upper surface of the base wall 52 in correspondence to each cavity 15. The removal prevention projection 55 engages a rear-end jaw 35 of the female terminal fitting 30 to prevent removal of the female terminal fitting 30 from the cavity 15. Jig insertion openings 56 open on the front lower surfaces of the retainer 50 within the thickness range of the base wall 52. A jig (not shown) can be inserted into the jig insertion opening 56 to unlock the female terminal fitting 30 from the retainer 50 when the retainer 50 is at the main locking position.

A front end of each side plate 53 is forward from the front end of the base wall 52. Each side plate 53 is elastically deformable in and out with respect to the base wall 52. Thus the side plates 53 slide vertically between the temporary locking position and the main locking position, with the side plates 53 sandwiching the retainer-mounting surface 19 therebetween with an elastic force. The to-be-locked portions 51 are near the free ends of each side surface 53 and are configured to engage the front temporary lock 17A, the rear temporary lock 17B, and the main lock 18. The to-be-locked portion 51 projects inward in the shape of a claw from the free end of each side plate 53 and extends longitudinally over almost the entire longitudinal length of each side plate 53. A to-be-locked surface 57 is formed on each to-be-locked portion 51 and faces down towards the base wall 52. The to-be-locked surface 57 of the to-be-locked portion 51 is approximately horizontal and flat for tightly contacting the flat removal-prevention surface 17E of the rear temporary lock 17B of the female housing 10. A to-be-guided surface 58 slopes down and in from an upper end of the to-be-locked portion 51. The to-be-guided surface 58 contacts the guide surface 17C of each of the front and rear temporary locks 17A and 17B as the retainer 50 moves to the temporary locking position.

Figure 3:
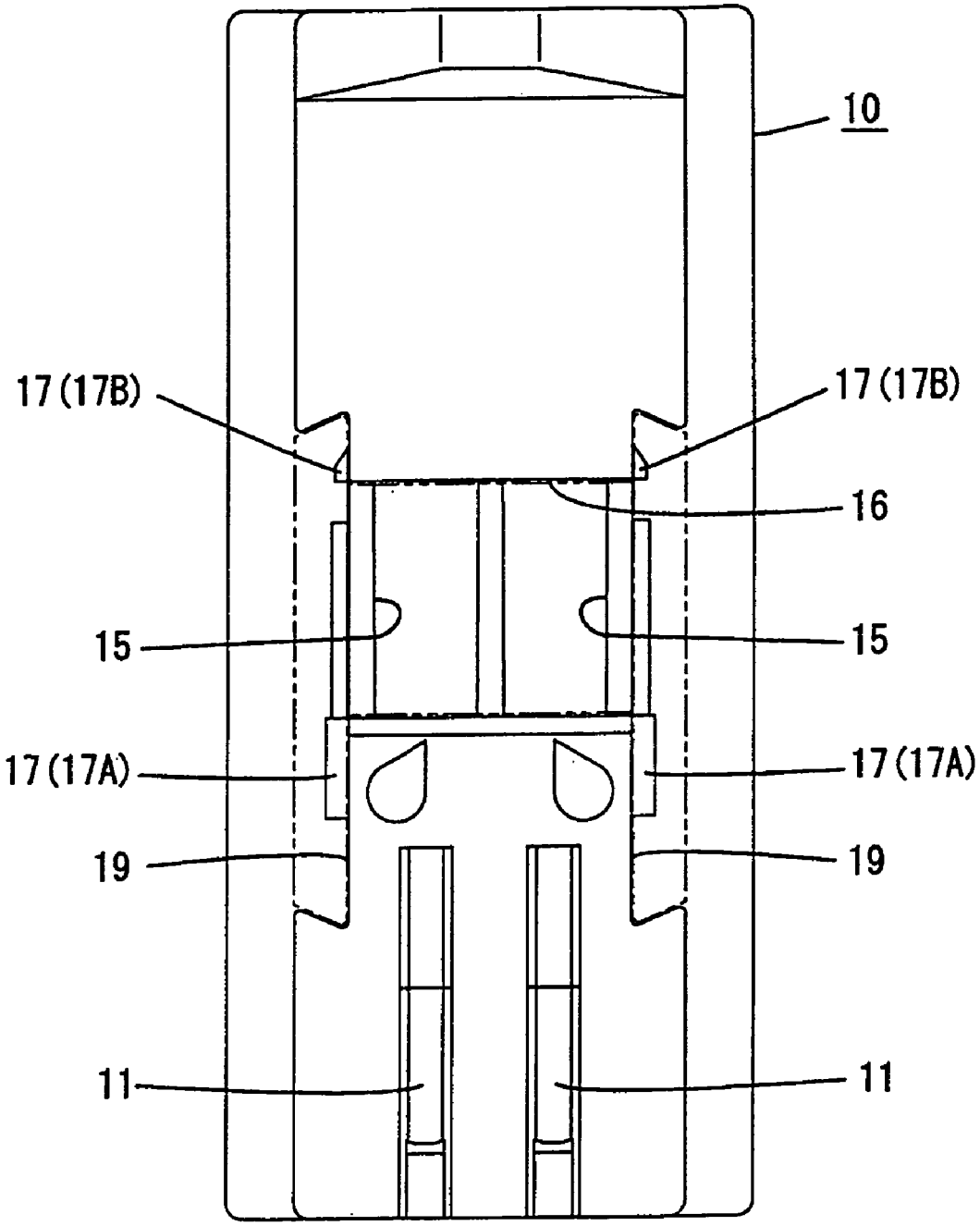
FIG. 3 is a bottom view showing the connector before the retainer is mounted on the connector housing.

The retainer 50 is moved up to the lower side of the female housing 10 for mounting, as shown in FIGS. 1 through 3. As a result, the retainer-mounting surfaces 19 are sandwiched between the side plates 53. The base wall 52 then is pressed towards the female housing 10 to move the retainer 50 up. As a result, the to-be-guided surfaces 58 of the to-be-locked portions 51 slidably contact the guide surfaces 17C of the front and rear temporary locks 17A and 17B. Thus, the side plates 53 deform elastically out, and the to-be-guided surfaces 58 ride across the guide surfaces 17C. The side plates 53 return resiliently towards their original states when the to-be-locked portions 51 reach the temporary locking position, and the to be-locked portions 51 move into and are retained in the gaps between the main locks 18 and the front and rear temporary locks 17A and 17B. At this time, the front and rear temporary locks 17A and 17B engage the front and rear ends of the to-be-locked portion 51 of each side plate 53. Thus the retainer 50 is inserted into the female housing 10 in a stable posture. As shown in FIG. 5, the removal prevention projection 55 of the retainer 50 is disposed at a waiting position outside the cavity 15 so that the removal prevention projection 55 does not prevent the insertion of the female terminal fitting 30 into the cavity 15.

Thereafter, the female terminal fitting 30 is inserted into the cavity 15 from the rear. As a result, the locking projection 34 of the square pillar 31 contacts the lance 11, and deforms the lance 11 down. The lance 11 returns resiliently to its original state when the front end of the square pillar 31 reaches the front end of the cavity 15. Thus, the to-be-locked portion 12 of the lance 11 advances to the rear surface of the locking projection 34 and achieves primary locking of the female terminal fitting 30.

Figure 6:
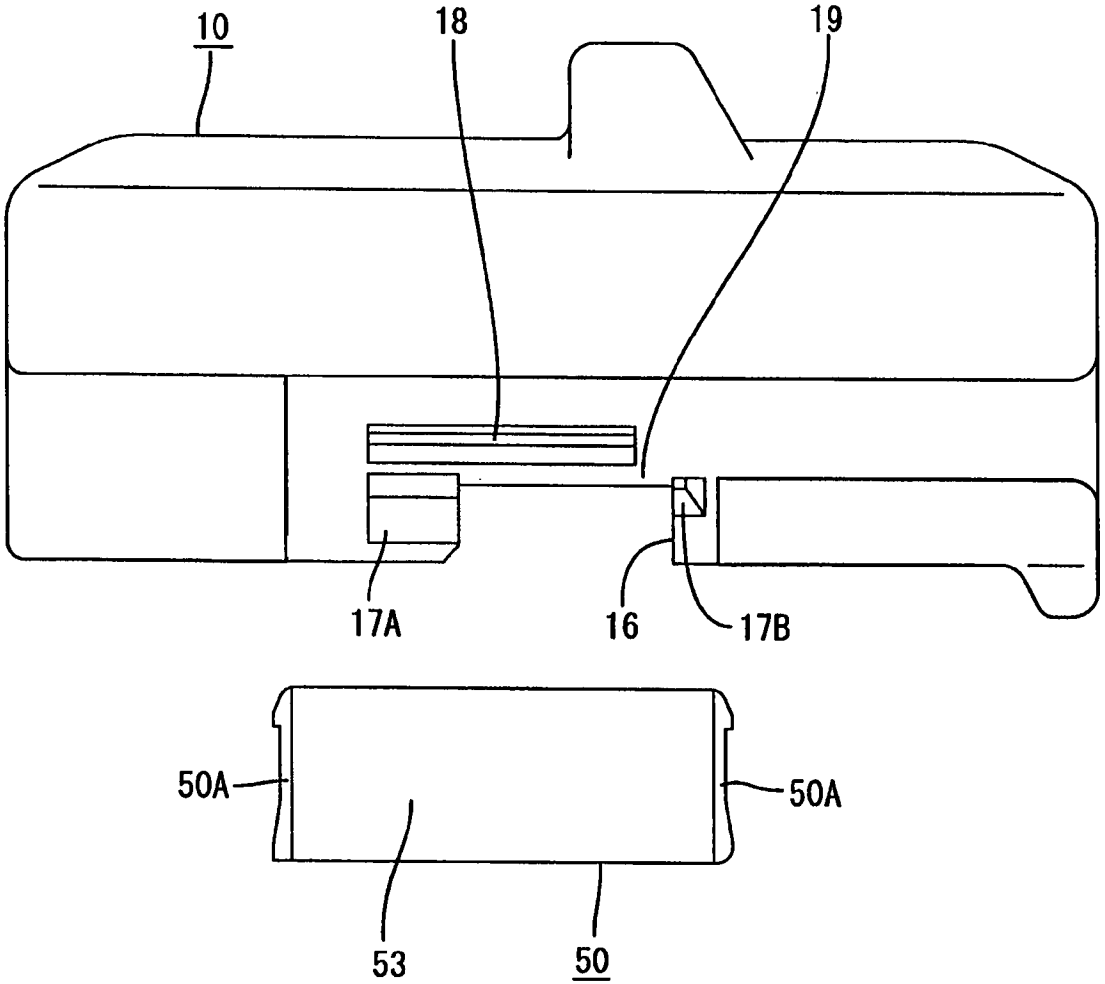
FIG. 6 is an exploded side view showing the connector before the retainer is mounted thereon.

The retainer 50 then is pressed deep into the retainer-mounting hole 16. Thus, the to-be-guided surfaces 58 of the to-be-locked portions 51 slidably contact the guide surfaces 18A of the main locks 18, with each side plate 53 deforming out elastically. Each side plate 53 returns to its original state when the to-be-locked portion 51 reaches the main locking position and the to-be-locked portion 51 is locked to the main lock 18. Simultaneously, as shown in FIG. 6, the removal prevention projection 55 of the retainer 50 advances to the rear of the rear jaw 35 from the waiting position to lock the female terminal fitting 30 doubly. As shown in FIGS. 4 and 8, the to-be-locked portion 51 is locked to the main lock 18 over its whole longitudinal length. As a result, the retainer 50 is held securely at the main locking position.

The removal prevention projection 55 will strike the lower surface of the square pillar 31 and prevent further movement of the retainer 50 if the female terminal fitting 30 is inserted only partially into the cavity 15. Thus it is possible to detect the partial insertion.

As described above, main locks 18 are on the two opposite surfaces of the housing that have the retainer-mounting hole 16. The main locks 18 are above the peripheral edge of the retainer-mounting hole 16, and at a front side in the insertion direction of the retainer 50. Therefore, locking at the main locking position is at the center of the retainer 50, and the mounting posture of the retainer 50 is stable at the main locking position. Accordingly, the retainer 50 is locked reliably at the main locking position. Further, the first and second temporary locks 17A and 17B are forward and rearward respectively from the retainer-mounting hole 16. Thus, the connector has a small vertical dimension and the retainer 50 is stable at the temporary locking position.

Further, the main locks 18 extend along the upper peripheral edges of the retainer-mounting hole 16 on both side surfaces of the female housing 10. Thus, the to-be-locked portion 51 is locked to the main lock 18 in a large area to lock the retainer 50 with a high reliability.

Figure 11:
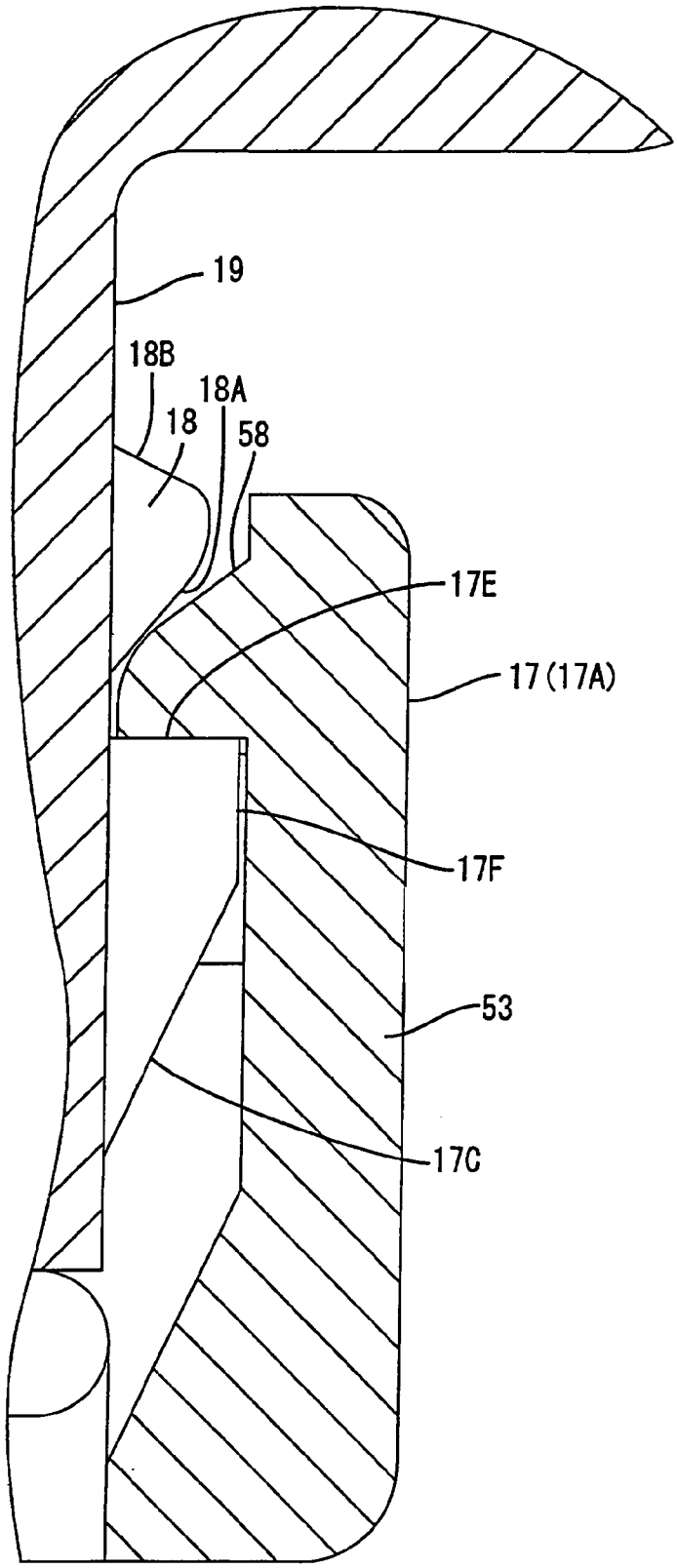
FIG. 11 is an enlarged transverse sectional view showing the connector when the retainer is at the temporary locking position.
Figure 12:
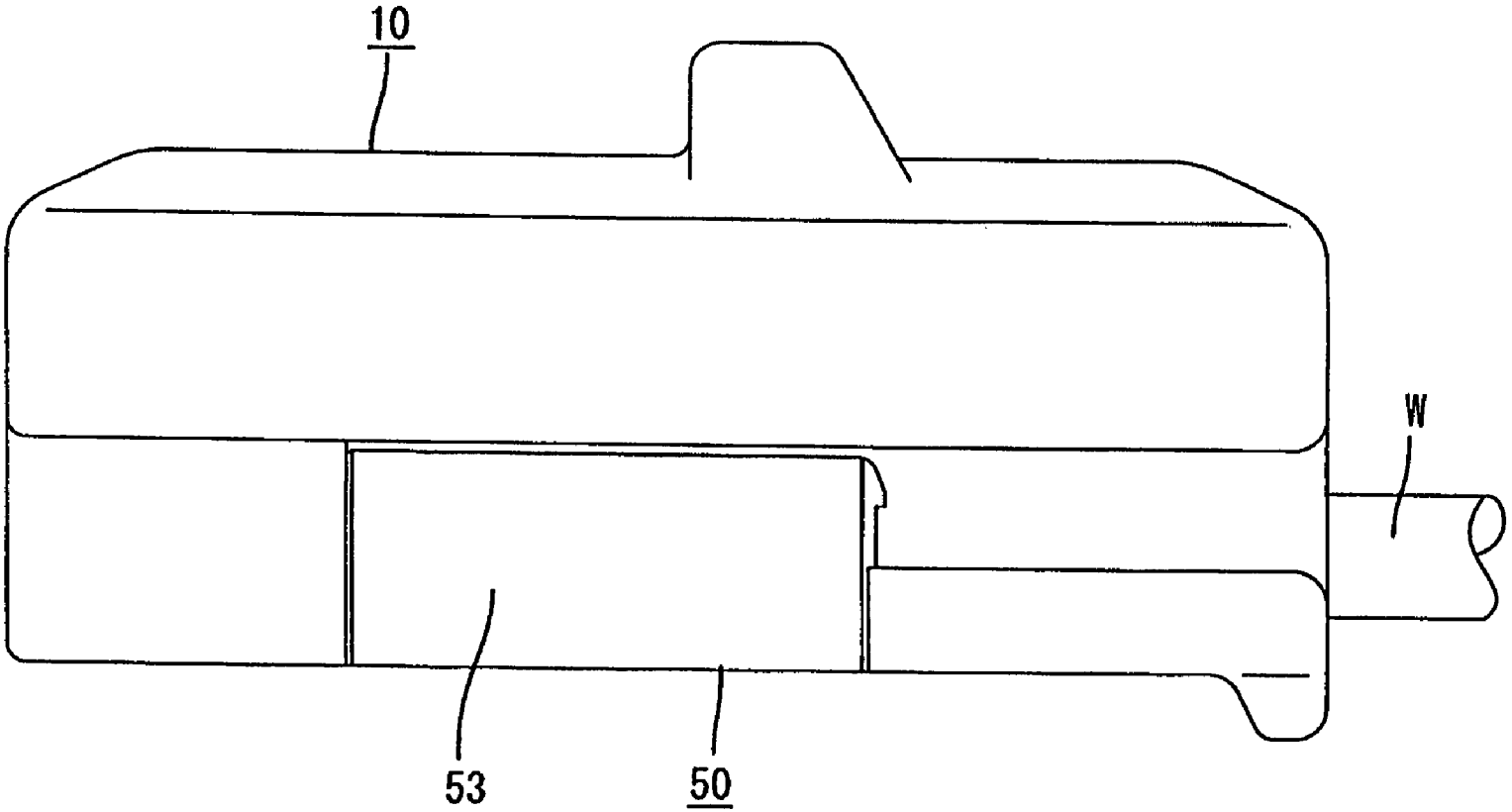
FIG. 12 is a side view showing the connector when the retainer is disposed at a main locking position.
Figure 13:
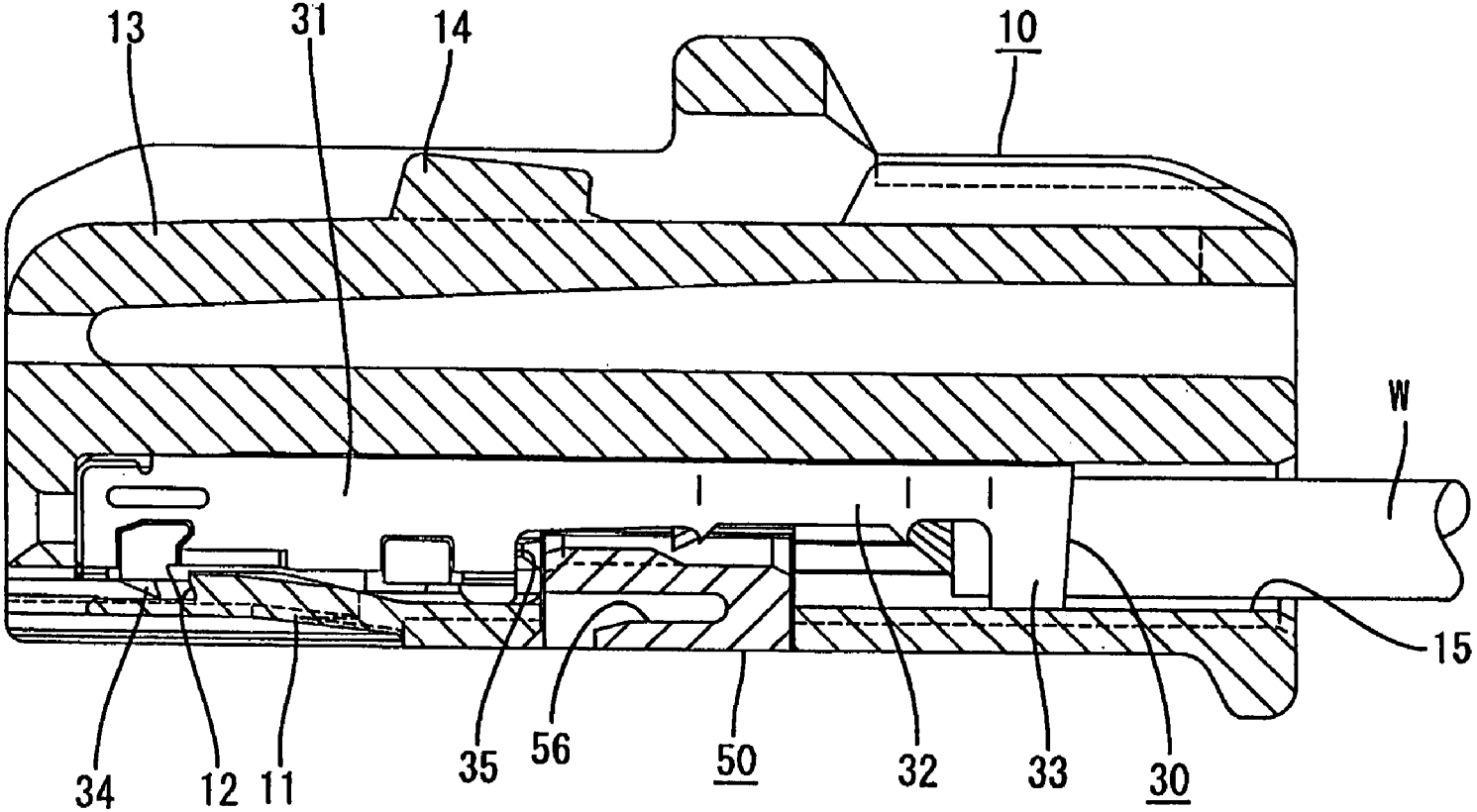
FIG. 13 is a longitudinal sectional view showing the connector when the retainer is at the main locking position.
Figure 14:
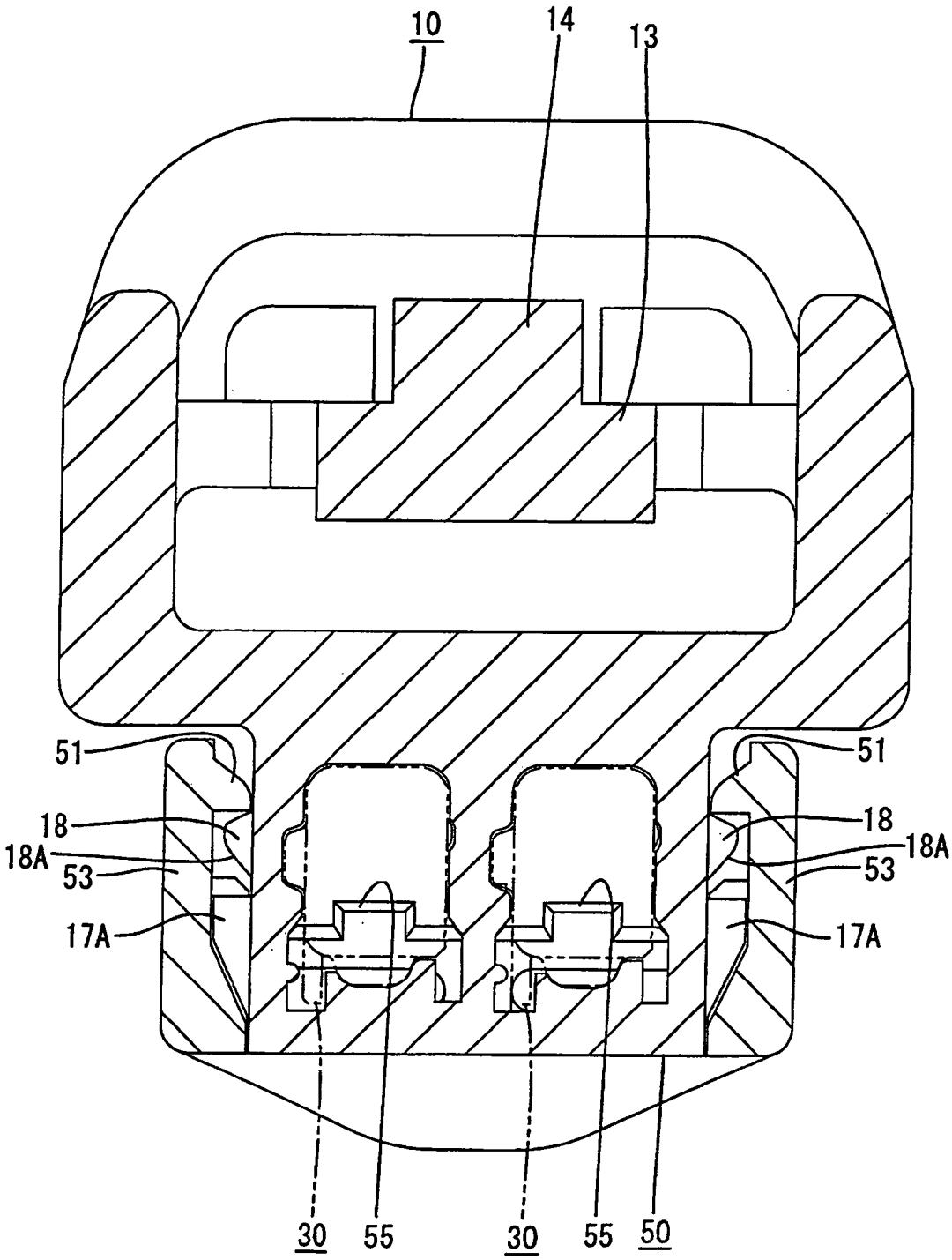
FIG. 14 is a transverse sectional view showing the connector when the retainer is disposed at the main locking position.
Figure 15:
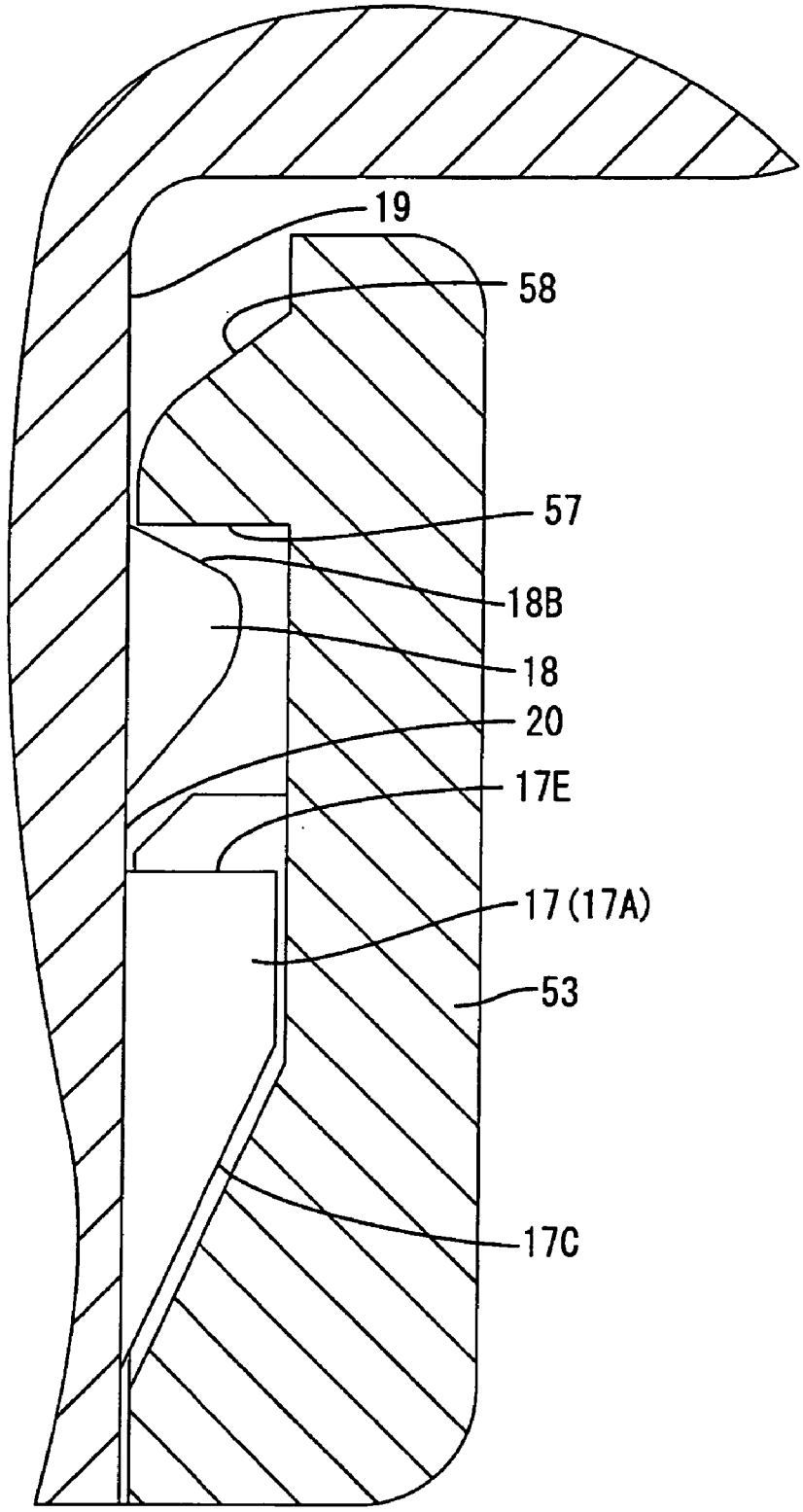
FIG. 15 is an enlarged transverse sectional view showing the connector when the retainer is at the main locking position.

The to-be-locked portions 51 make line contact with the movement guide surfaces 18B of the main locks 18 when the retainer 50 is in the main locking position. The line contact extends in the longitudinal direction of the housing 10 and in a direction substantially orthogonal to the movement direction of the retainer 50, as shown in FIG. 11. A jig is inserted into the jig insertion hole 56 of the base wall 52 to move the retainer 50 from the main locking position to the temporary locking position. Thus, the side surfaces 53 deform elastically outward so that the retainer 50 can be pulled down. As a result, the to-be-locked surfaces 57 of the to-be-locked portions 51 slidably contact the movement guide surfaces 18B of the main locks 18 and ride across the movement guide surface 18B. The side surfaces 53 return resiliently to the original state when the movement guide surfaces 18B reach the temporary locking position and the to-be-locked portion 51 is locked to the temporary locks 17A, 17B. At this time, as shown in FIG. 14, the to-be-locked surface 57 of the to-be-locked portion 51 and the removal prevention surface 17E make a surface contact in the direction substantially orthogonal to the movement direction of the retainer 50.

The to-be-locked surface 57 of the to-be-locked portion 51 slidably contacts the movement guide surface 18B of the main lock 18 while moving the retainer 50 from the main locking position to the temporary locking position. Therefore a large operational force is not required to unlock the retainer 50 at the main locking position. Further when the retainer 50 has reached the temporary locking position, the to-be-locked surface 57 of the to-be-locked portion 51 contacts the removal prevention surface 17E of the rear temporary lock 17B in a direction substantially orthogonal to the movement direction of the retainer 50. Therefore it is possible to prevent the removal of the retainer 50 from the temporary locking position.

The to-be-locked surface 57 of the to-be-locked portion 51 and the movement guide surface 18B of the main lock 18 make a line contact in a direction substantially orthogonal to the movement direction of the retainer 50. Thus, the retainer 50 can be unlocked easily at the main locking position. However, the to-be-locked surface 57 of the to-be-locked portion 51 and the removal prevention surface 17E make surface contact at the temporary locking position. Therefore it is possible to prevent the removal of the retainer 50 from the temporary locking position. Accordingly an operator who continues pulling without realizing that the retainer 50 has reached the temporary locking position will encounter a large resistance and will stop pulling.

The retainer 50 is capable of moving between the main locking position and the temporary locking position with the side surfaces 53 deforming elastically. Therefore this construction ensures a smooth unlocking operation at the main locking position and a smooth restoring operation of the side surfaces 53 at the temporary locking position.

The invention is not limited to the embodiment described above with reference to the drawings. For example, the following embodiments are included in the scope of the invention, and various other modifications can be made without departing from the spirit and scope of the invention.

The front temporary lock is larger than the rear temporary lock in the illustrated embodiment. However, the temporary locks may be the same size. Alternatively, the front temporary lock may be smaller than the rear temporary lock.

Front and rear temporary locks are provided in the illustrated embodiment. However, only one temporary lock may be formed, provided that the temporary locks are on each side of the housing and at a side of the retainer-mounting hole in the insertion direction of the retainer.

The main lock may extend along almost the entire length of the upper edge of the retainer-mounting hole on both side surfaces of the female housing.

A female connector is described above. However, the invention may apply to a male connector.

The temporary locks and the main lock are on the housing, and the to-be-locked portion is on the retainer in the illustrated embodiment. However, the to-be-locked portion may be on the housing, and the temporary locks and the main lock may be on the retainer.

The rear temporary lock has the removal prevention surface substantially orthogonal to the movement direction of the retainer in the illustrated embodiment. However, the removal prevention surface may slope inverse to the movement direction of the retainer to prevent removal of the retainer from the temporary locking position.

A side retainer has been described and illustrated. However, the invention can be applied to a front retainer that is mounted on the housing in a direction in which the male and female housings are fit together.

What is claimed is:

1. A connector comprising:

a housing with at least one a cavity for accommodating a terminal fitting, the housing having a base surface and first and second opposite side surfaces adjacent the base surface, a retainer-mounting hole open into the base surface and partly into the first and second side surfaces, said retainer-mounting hole communicating with said cavity;

a retainer having a base wall and first and second side plates projecting from said base wall, said retainer being inserted into said retainer-mounting hole of said housing along an insertion direction so that said side plates elastically sandwich said side surfaces of said housing therebetween, a to-be-locked portion provided on each of said side plates;

first and second temporary locks on each of said side surfaces of said housing and disposed so that a portion of said retainer-mounting hole open on said side surfaces is between said first and second temporary locks on the respective side surface, said temporary locks engaging said to-be-locked portions for retaining said retainer at a temporary locking position at which said retainer permits said terminal fitting (30) to be inserted in and removed from said cavity; and main locks on each of said side surfaces of said housing and engaging said to-be-locked portions for retaining said retainer at a main locking position at which said retainer locks said terminal fitting.

2. The connector of claim 1, wherein said main locks extend substantially along a peripheral edge of said retainer-mounting hole that confronts a front side in said insertion direction of said retainer.

3. The connector of claim 1, wherein said temporary locks are substantially adjacent portions of said retainer-mounting hole open on said side surfaces of said housing.

4. The connector of claim 1, wherein said main lock has a movement guide surface inclining along a direction of a movement of said retainer from said main locking position to said temporary locking position, and said temporary lock has a removal prevention surface aligned substantially orthogonal to said movement direction of said retainer.

5. The connector of claim 4, wherein said to-be-locked portion and said movement guide surface are configured to make a line contact in a direction substantially orthogonal to said movement direction of said retainer at said main locking position; and said to-be-locked portion and said removal prevention surface are configured to make a surface contact at said temporary locking position.

6. The connector of claim 1, wherein said main lock has a movement guide surface inclining along a direction of a movement of said retainer from said main locking position to said temporary locking position, and said temporary lock has a removal prevention surface aligned with an inverse slope to said movement direction of said retainer.

7. The connector of claim 1 wherein said to-be-locked portions project inward from each of said side plates.

8. A connector, comprising:

a housing with opposite front and rear ends and at least one a cavity extending between the ends, the housing having a base surface and opposite side surfaces adjacent the base surface, a retainer-mounting hole open into the base surface and partly into the side surfaces, said retainer-mounting hole communicating with said cavity;

a retainer having a base wall and two side plates projecting from said base wall, said retainer being inserted into said retainer-mounting hole of said housing so that said side plates sandwich said side surfaces of said housing therebetween, a to-be-locked portion provided on each of said side plates;

a front temporary lock formed on each of the side surfaces of said housing between the retainer-mounting hole and the front end of the housing, a rear temporary lock formed on each of the side surfaces of said housing between the retainer-mounting hole and the rear end of the housing, the front and rear temporary locks being engageable with said to-be-locked portions for retaining said retainer at a temporary locking position where the retainer does not interfere with the cavity; and a main lock formed on each of the side surfaces of said housing and being engageable with said to-be-locked portions for retaining said retainer at a main locking position at which said retainer projects into the cavity.

9. The connector of claim 8, wherein all portions of the retainer-mounting hole that open into the side surfaces of the housing are between the main locks and the base surface of the housing.

10. The connector of claim 8, wherein at least one of said temporary locks has a removal prevention surface facing away from the base surface of the housing and aligned substantially parallel to the base surface of the housing.

11. The connector of claim 10, wherein said to-be-locked portions and said main locks are configured to make line contact when said retainer is at said main locking position; and said to-be-locked portions and said removal prevention surface are configured to make a surface contact when the retainer is at said temporary locking position.

12. A connector, comprising:

a housing with at least one a cavity for accommodating a terminal fitting, the housing having a base surface and opposite side surfaces adjacent the base surface, a retainer-mounting hole open into the base surface and parts of the side surfaces, said retainer-mounting hole communicating with said cavity, a main lock formed on each of the side surfaces of said housing, first and second temporary locks formed on each of the side surfaces of said housing between the main locks and the base surface so that a portion the retainer-mounting hole open on the side surfaces is between the first and second temporary locks on the respective side surface, at least one of said temporary locks having a removal prevention surface facing away from the base surface of the housing; and a retainer having a base wall and two side plates projecting from said base wall, said retainer being inserted into said retainer-mounting hole of said housing and being movable between a main locking position at which said retainer projects into the cavity and a temporary locking position where the retainer does not project into the cavity, a to-be-locked portion provided on each of said side plates, said to-be-locked portions being engageable with said main locks when said retainer is at the main locking position and being engageable with the removal prevention surface of at least one of the temporary locks in surface-to-surface contact when said retainer is at the temporary locking position.

13. The connector of claim 12, wherein the removal prevention surface is substantially parallel to the base surface of the housing.

14. The connector of claim 12, wherein the removal prevention surface is substantially normal to a direction of movement of the retainer.

15. The connector of claim 14, wherein the to-be-locked portions are configured to achieve substantially line contact with the main locks when the retainer is in the main locking position.

16. The connector of claim 12, wherein the to-be-locked portions are configured to achieve substantially line contact with the main locks when the retainer is in the main locking position.

* * * * *